US006002377A

United States Patent [19]

Huynh et al.

[11] Patent Number: 6,002,377

[45] Date of Patent: Dec. 14, 1999

[54] QUADRIFILAR HELIX ANTENNA

[75] Inventors: Son Huy Huynh; George Cheng, both of Torrance, Calif.

[73] Assignee: Antcom, Torrance, Calif.

[21] Appl. No.: 09/075,010

[22] Filed: May 8, 1998

[51] Int. Cl.[6] ..... H01Q 1/36; H01Q 1/24

[52] U.S. Cl. ..... 343/895; 343/702

[58] Field of Search ..... 343/895, 702, 343/900, 901

[56] References Cited

U.S. PATENT DOCUMENTS 5,808,585 9/1998 Frenzer et al. ..... 343/872

*Primary Examiner*—David H. Vu
*Assistant Examiner*—Jennifer H Malos
*Attorney, Agent, or Firm*—Roger A. Marrs

[57] ABSTRACT

A low cost quadrifilar helix antenna having a molded body providing an elongated hollow radome supporting at least one radiating elements and a feed network within the body. In one form, the body is molded in two identical half sections so as to be joined together into a unitary construction with the feed network and radiating elements being applied to the internal surface by a plating procedure. In another form, the molded body is a thick walled cylinder having at least one spiral passageway occupied by inserted wires constituting the radiating elements.

12 Claims, 2 Drawing Sheets

13
11
10

16'
11
16

11
5
5
16
15
14
16'
16

15'
15
17
18
20
21
25

11
16
16
15'
15
26
31
27
28
31
22
23

QUADRIFILAR HELIX ANTENNA

BACKGROUND OF THE INVENTION

1. Field of the Invention

This present invention relates to transceiver antennas for use in accessing lower earth orbit, stationary geo-syncronous and/or geo-stable satellites, and more particularly to such an antenna employing low cost manufacturing construction for quadrifilar helix antennas.

2. Brief Description of the Prior Art

Conventional communication systems are known in the prior art for providing a communications link between satellites which continuously transmit information and a hand-held transceiver unit such as a mobile telephone or the like. The transceiver may be at a stationary base or may be located in a mobile vehicle. The accuracy of satellite transmission is dependent on the quality of the signal detected from the satellite by the transceiver antenna. Hence, the system requires a sufficiently accurate receiver and antenna arrangement such that the antenna must be small and portable with a hemispherical beam pattern broad enough to detect signals from satellites located anywhere in the hemisphere. For this purpose, the quadrifilar helix antenna has been found to be well suited.

Attempts have been made to produce quadrifilar helix antennas for satellite signal reception such as those disclosed in U.S. Pat. Nos. 5,349,365; 5,198,831; 5,134,422 and 5,485,170. Difficulties and problems have been encountered with these prior art antennas in that the complexity of manufacture has led to substantial costs in fabrication and production and therefore, such antennas are not readily easy to produce. Difficulty in construction resides in the fact that the helix includes continuous filament winding about a standard form or requires bending of filaments or ribbons about a form or even entails costly etching techniques to place the filaments or ribbons onto a form. Thus, prior art quadrifilar helix antennas involving such constructions are impractical for lower antenna costs and such antennas are not necessarily enclosed to protect the current carrying filaments or ribbons such that the antenna design is too delicate for rough handling and adverse environmental conditions.

Therefore, a long-standing need has been in existence to provide a low cost quadrifilar helix antenna for satellite telecommunication applications in which it is desirable to both transmit and receive capabilities in a telecommunication unit such as a cellular phone or the like and wherein the antenna must be able to efficiently transmit radio signals to the satellite and receive return signals as well. In order to provide low cost, it is preferred that the antenna be constructed by means of using injection molding techniques as well as using conventional plating fabrication methods.

SUMMARY OF THE INVENTION

Accordingly, the above problems and difficulties are avoided by the present invention which provides a novel quadrifilar helix construction which includes an elongated injection molded radome composed of a pair of snap-together component halves so as to provide an enclosed or hollow interior. The interior walls of the respective component halves include feed network elements as well as radiating elements which terminate at one end of the radome into input and output connections with a transceiver network. In one form of the invention, the feed network and radiating elements are plated onto the interior surface of the radome component halves and in another form of the invention, each of the respective component halves is provided with internal passageways in the wall thickness for accommodating insertion of feed network and radiating elements. In particular, the radiating element of the antenna may include at least one radiating element arranged in a helical pattern.

Therefore, it is among the primary objects of the present invention to provide a quadrifilar helix antenna which provides quality performance over the entire frequency range and meets all of the rugged environmental conditions and dimensional limitations placed on satellite communication systems.

Another object of the present invention is to provide a low cost quadrifilar helix antenna which is composed of an elongated radome having a pair of snap-together component halves wherein each half contains and mounts radiating elements and feed network elements.

A further object of the present invention is to provide a low cost quadrifilar helix antenna which employs fewer component parts and is easy to produce with external protection and allows for easy antenna service and maintenance procedures.

Yet another object of the present invention is to provide a novel low cost quadrifilar helix antenna comprising a radome having a pair of snap-together components in which two arms of the quadrifilar helix are carried on one component half of the radome while the other two arms of the radiating elements are carried on the other half component.

Yet another object resides in placing the feed network and radiating elements into a radome by employing inexpensive plating techniques and by using injection molding fabrication for radome construction.

Yet another object resides in producing and placing antenna feed network elements as well as radiating elements onto the interior surface of a hollow radome without employing etching procedures, continuous filament or ribbon construction and which does not require bending or crossover techniques to produce proper radiating functions.

A further object resides in providing a radome with a quadrifilar helix incorporated into a hollow housing having a cylindrical wall with internal spiral grooves defined by spaced-apart parallel ribs or rails into which wires, plated filaments or cables may be held in a helix pattern.

Another object resides in an elongated hollow radome for an antenna having at least one spiral groove on the inner surface of the radome for holding inserted, plated or snap-in-place electrical wires, filaments or cables representing electrical energy radiators or collectors and which are operably connected to a transceiver circuit network.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figures 1, 2, 3, 4, 5, 6:
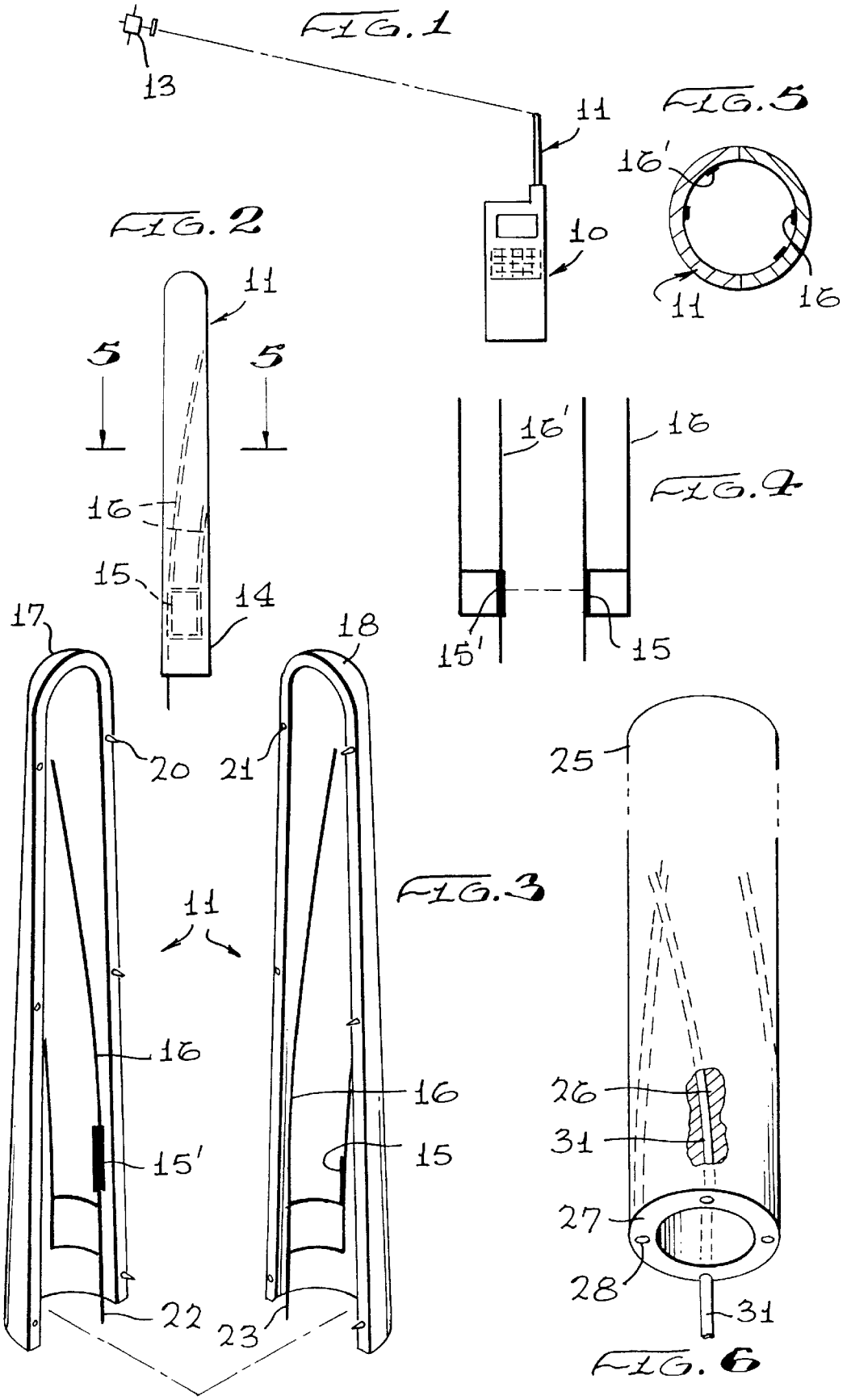
FIG. 1 is a diagrammatic drawing of a typical cellular communication device incorporating the novel quadrifilar helix antenna of the present invention and illustrated in connection with signal reception from a satellite.
FIG. 2 is an enlarged side elevational view of the novel quadrifilar helix antenna of the present invention as used on the cellular communication device shown in FIG. 1.
FIG. 3 is a greatly enlarged perspective view showing the antenna radome incorporating the present invention and illustrating the radome comprising a pair of component halves.
FIG. 4 is a diagrammatic view illustrating the feed network elements and the radiating elements incorporated on the interior surface of the radome halves as illustrated in FIG. 3.
FIG. 5 is a transverse cross-sectional view of the antenna shown in FIG. 2 as taken in the direction of arrows 5—5 thereof.
FIG. 6 is a bottom perspective view showing an alternate construction for the low cost quadrifilar helix antenna in accordance with the present invention.

Referring to FIG. 1, a cellular telephone is indicated by numeral 10 which includes an antenna 11 that incorporates the present invention. The antenna 11 is intended to receive communication signals from a remote location such as a satellite 13 in connection with satellite telecommunication applications. The antenna 11 is suitable for operation with a mobile communication system as well as for a cellular telephone and other telecommunication systems can also use this antenna.

Referring to FIG. 2, the antenna 11 is illustrated as being a radome having an end 14 which may suitable be mounted onto the housing or case of the telephone 10. The antenna radome 11 includes a feed network, indicated by numeral 15, which is operatively connected to radiating elements broadly indicated by numeral 16. It is to be particularly noted that the feed network and the radiating elements are internal of the antenna radome 11 so that the exterior surface thereof is smooth and does not mount or support either the network or components or elements externally.

Referring now in detail to FIG. 3, it can be seen that the antenna radome 11 includes a pair of half sections, indicated by numerals 17 and 18 respectively. The half sections may be joined together by any suitable means such as a snap-lock relationship wherein pins, such as pin 20, may be insertably received within an aperture or hole 21 in the opposite section. It can also be seen that each of the respective sections is provided with an internal channel so that when the sections are joined together, a hollow internal bore is provided. The inside surface of the bore on each half section includes a plated circuit comprising the feed network and the radiating elements. Plating of these electrical components is comparatively easy since the plating procedure takes place when the half sections are opened and the interior surface is available to receive the plating material. Each of the respective radiating elements is arranged in a helix on the inside surface of the respective sections 17 and 18. An input/output terminal is indicated respectively by numerals 22 and 23. Therefore, it can be seen that the sensitive electrical elements are enclosed by the antenna radome 11 and that the external surface is relatively smooth and serves as a barrier for the internal electrical components from the environment.

Referring now to FIG. 4, a diagrammatic illustration is presented showing the feed networks 15 and 15' associated with each of their respective half sections 17 and 18. Also illustrated are the radiating elements 16 and 16' additionally associated with each of the respective half sections of the radome. It is to be understood that the radiating elements 16 and 16' are arranged in a helix on the inside of each of the respective half sections so that a quadrifilar helix antenna is produced.

In FIG. 5, it can be seen that the interior of the combined half segments into the radome antenna 11 is hollow and that the plated radiating elements 16 and 16' are carried on the inside surface of the antenna. The thickness of the radome wall protects the internal feed network and radiating elements from being damaged by environmental conditions.

Referring now in detail to FIG. 6, another version of the invention is illustrated wherein the radome antenna includes a housing 25 taking the form of a hollow cylinder in which helical passageways, such as indicated by numeral 26, are formed in the thickness of the wall 27. A wire may then be introduced through the opening such as opening 28, and may be inserted through the passageway until it terminates at the end of the passageway. Therefore, the radiating element, as indicated by numeral 30, may be installed within the cylinder 25 and is protected by the wall thickness which surrounds each of the respective wires. An input/output means is indicated by numeral 31 and may be electrically connected to the other radiating elements represented by wires in the other additional passageways. Such a manufacturing of the radome with the radiating elements is inexpensive and is not labor intensive.

In view of the foregoing, it can be seen that the embodiments of the present invention illustrated in FIGS. 2–5 inclusive and in FIG. 6 provide a low cost quadrifilar helix antenna of which productivity can be readily increased by employing either molding and plating techniques or by employing molding and wire insertion procedures. The spacing and placement of the helix elements 16 and 16' on the respective radome sections 17 and 18 and the spacing of the wire helix elements 31 on the cylindrical radome 25 determines the polarization and radiation characteristics of the antenna. Also, the angle of pitch of the helix elements contributes to these characteristics. The embodiments of the present invention provide an especially simple helical antenna structure eliminating many parts or components necessary when compared with conventional antennas. By employing low cost manufacturing procedures and techniques, a particularly simple method is provided to manufacture a helical type antenna which can be very easily adapted to satellite communication applications with excellent qualities of reproducibility and automation. Hence, the present invention provides a quadrifilar helix antenna which is small in size and portable with an omnidirectional beam pattern broad enough to detect signals from satellites located anywhere in the hemisphere. The inventive antenna employing the manufacturing procedures described herein also provides quality performance over the entire frequency range and meets all of the rugged environmental conditions and dimensional limitations placed upon satellite communication systems.

Figure 7:
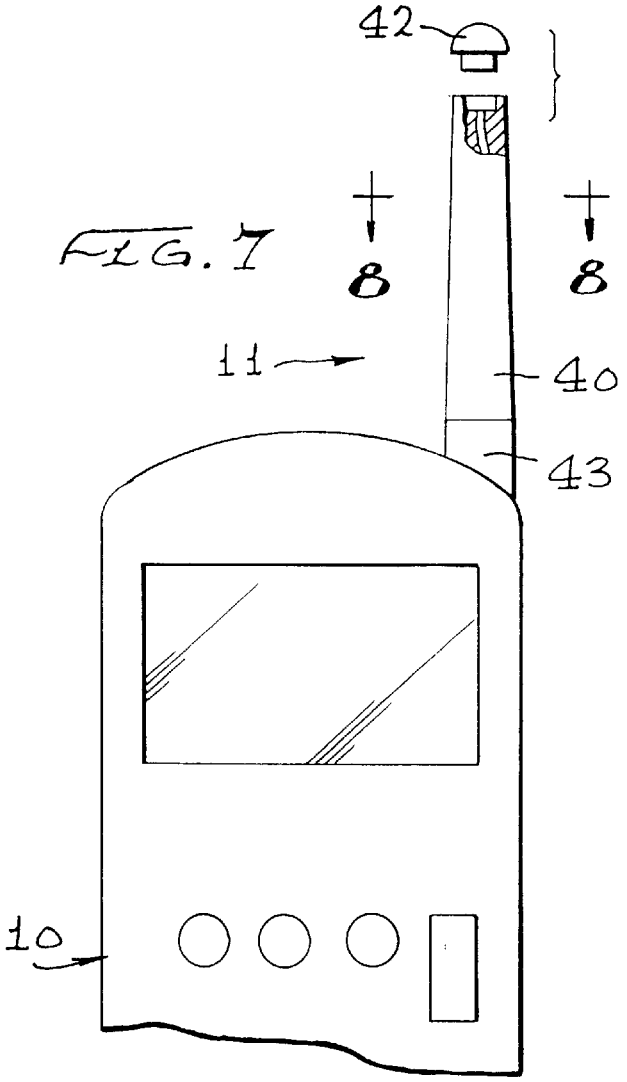
FIG. 7 is an enlarged exploded view of the cellular communication device of FIG. 1 illustrating the components of the quadrifilar helix antenna.
Figure 9:
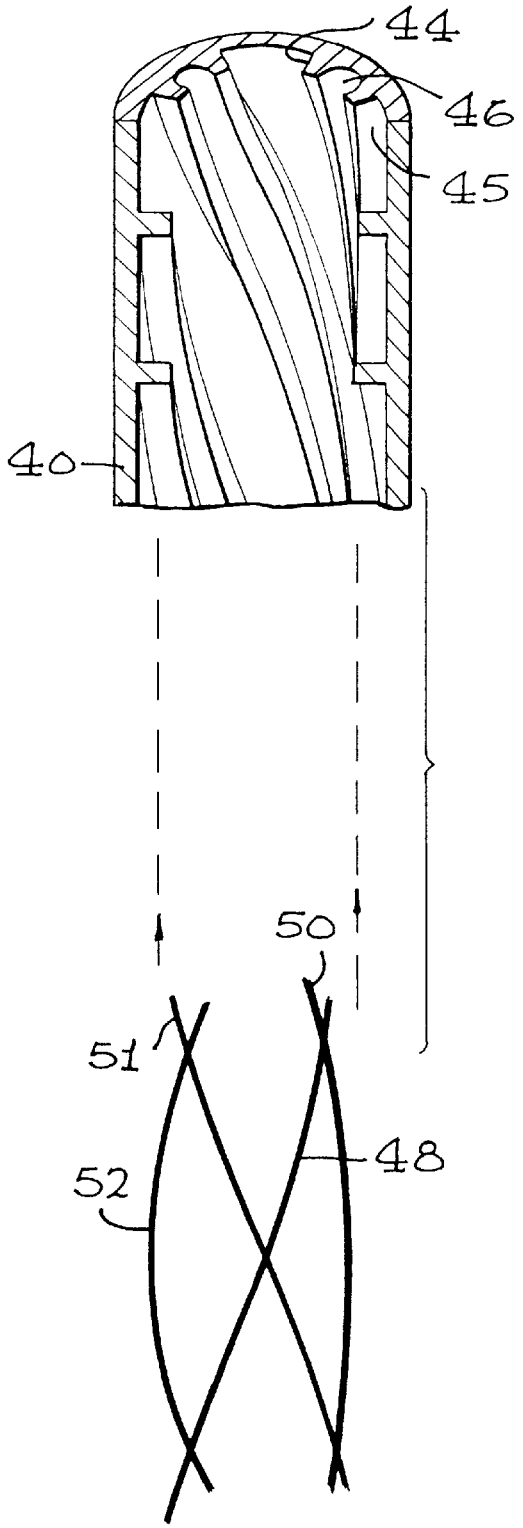
FIG. 9 is a perspective view of the quadrifilar helix wires or cables preparatory for assembly or installation within the grooves of the radome housing.
Figure 8:
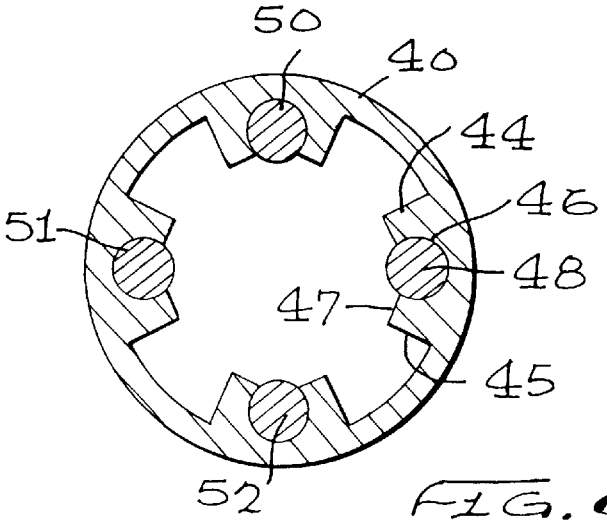
FIG. 8 is a transverse cross-sectional view of the radome for housing the quadrifilar helix as taken in the direction of arrows 8—8 of FIG. 7.

Referring now in detail to FIGS. 7, 8 and 9, another version of the invention is disclosed wherein the antenna 11 carried on the cellular phone or unit 10 includes a central elongated cylindrical housing 40 for enclosing a suitable helix installation. The helix elements are internal and a radiator or conductor in the helix is represented by numeral 41. One end of the helix elements terminates at a cap 42 which closes one end of the cylinder 40 while the opposite end is attached to and operably connected to a feed network within a housing 43.

Referring to FIG. 8, it can be seen that the cylinder 40 of the radome antenna is hollow and includes at least four sets of ribs or rails, such as indicated by numerals 44 and 45, which are arranged in fixed spaced-apart relationship so as to define a groove 46 having a reduced entrance at numeral 47 for holding and retaining a wire or the like 48 which is one of the radiating elements. At least four helix elements are employed and are represented by numerals 50, 51 and 52 in addition to the element 48. These latter elements are held and retained in a helix geometric configuration by the rib or rail and groove arrangement immediately described with respect to the element 48. The number of grooves may be from one to any additional multiples and the cross-section of each groove between the circular rails can be of any geometric shape, such as hexagon, triangle, square, rectangle or the like. The geometric shape serves to hold the helix elements onto the interior of the radome and also permit the elements to be bent into a desired curvature. The helix elements can be straight coaxial cable, wires or printed circuit strips or the like. The cross-section of the helix elements can be of any geometric shape or combination of shapes so as to be matable with the geometric shape of the grooves.

Referring now in detail to FIG. 9, it can be seen that the quadrifilar helix elements are pre-shaped and that the helix elements can be straight coaxial cable, wires or printed circuit strips. The cross-section of the helix elements can also be of any geometric shape, as previously described, and the helix elements can be installed into the grooves from either side of the cylindrical radome 40. The radome will hold and curve the helix elements into desired configurations. The lower end of the helix elements can be suitable coupled with the feed network 43 within the housing and the upper end of the cylindrical housing 40 may be capped or terminated with the cap 42. The ribs or rails defining the grooves may be molded into the cylindrical housing 40 and the degree of winding of the grooves is obtained from detailed antenna design but it is understood that the angles may be of any suitable degree. Again, the grooves defined by the ribs or rails will hold and will curve the quadrifilar helix elements into the desired angular configuration.

Therefore, the handset cellular phone 10 can be used for satellite telecommunication with the antenna 11 attached thereto. The antenna 11 is the subject of the present invention and is illustrated as a radome with its inner surface being shaped into a plurality of grooves, such as groove 46. The grooves allow the quadrifilar helix elements 48–52, as examples, to be curved and attached within the hollow or bore of the cylindrical housing of the radome by simply inserting the straight quadrifilar helix filaments, wires or cables into the respective grooves from either side or end of the radome. The radome can be mass-produced by injection molding methods from any dielectric or magnetic materials.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A low cost quadrifilar helix antenna for use in satellite telecommunication applications comprising:

a dielectric hollow elongated radome having an exterior surface and internal surface; and a feed network carried on said internal surface adjacent a selected end of said radome; and a plurality of radiating elements arranged in a given geometric arrangement in electrical connection with said feed network and carried on said internal surface extending from said feed network to an opposite end of said radome from said selected one end; and said feed network and said radiating elements are plated in fixed spaced-apart relationship to said internal surface.

2. The quadrifilar helix antenna defined in claim 1 wherein:

said radome is molded into an elongated hollow body with said selected one end open into the interior of said radome and an opposite end being closed.

3. The quadrifilar helix antenna defined in claim 2 wherein:

said radome body includes a pair of identical half sections adapted to be joined together to provide a single unitary construction with a portion of said radiating elements carried on one half section of said pair and the other radiating elements carried on the other half section of said pair.

4. The quadrifilar helix antenna defined in claim 3 wherein:

said radiating elements are arranged as multiple helixes coaxially disposed with respect to a central longitudinal axis of said radome; and signal input/output means coupled to said feed network.

5. The quadrifilar helix antenna defined in claim 1 wherein:

said hollow elongated radome includes a cylindrical wall having at least one spiral passageway leading through said cylindrical wall in fixed spaced-apart relationship;

said radiating elements comprising a wire conductor insertably received into each of said spiral passageway; and said hollow elongated radome being characterized as a single unitary molded construction.

6. In a quadrifilar helix antenna, the combination which comprises:

an elongated body having a central longitudinal axis;

said body having an open end and a closed end with a bore extending therebetween defined by an internal surface;

electrical conductors carried on said internal surface providing a spiral radiating array of at least four radiating elements coaxially disposed with respect to said central longitudinal axis;

a feed network carried on said internal surface adjacent said open end and in electrical coupling relationship with said radiating elements; and said body being of molded construction and said feed network and said radiating elements defined as plated components onto said internal surface.

7. The quadrifilar helix antenna as defined in claim 6 wherein:

said body consists of a pair of identical half sections with two radiating elements of said four being on each of said half sections.

8. The quadrifilar helix antenna as defined in claim 7 including:

snap-lock means carried on each body half section for cooperatively joining said half sections together to enclose said feed network and said radiating elements.

9. The quadrifilar helix antenna as defined in claim 8 wherein:

said body is a cylindrical wall having said internal surface and having an external surface separated from and insulating said radiating elements from external environmental conditions.

10. A method of manufacturing a low cost quadrifilar helix antenna including at least one radiating element comprising the step of:

molding an elongated hollow body with a cylindrical wall defining an internal surface; and plating metallic radiating element on said body for supporting and protecting said radiating element from adverse environmental conditions.

11. The method as defined in claim 10 wherein:

said molding step including molding said body in two identical half sections; and joining said mold half sections together to provide a single unitary construction.

12. The method as defined in claim 11 wherein:

said applying step includes the step of plating said radiating elements onto the internal surface whereby said wall separates said radiating elements from external environmental conditions.

* * * * *